United States Patent [19]

Pfeiler

[11] 4,433,431

[45] Feb. 21, 1984

[54] ROTATING ANODE X-RAY TUBE

[75] Inventor: Manfred Pfeiler, Erlangen, Fed. Rep. of Germany

[73] Assignee: Siemens Aktiengesellschaft, Berlin & Munich, Fed. Rep. of Germany

[21] Appl. No.: 371,925

[22] Filed: Apr. 26, 1982

[30] Foreign Application Priority Data

May 5, 1981 [DE] Fed. Rep. of Germany ..... 3117726

[51] Int. Cl.[3] ..... G21K 3/00

[52] U.S. Cl. ..... 378/157; 378/124; 378/125; 378/144

[58] Field of Search ..... 378/157, 124, 144, 125

[56] References Cited

U.S. PATENT DOCUMENTS 3,229,089 1/1966 Sasao .

3,683,223 8/1972 Dietz ..... 378/144

*Primary Examiner*—Craig E. Church

*Attorney, Agent, or Firm*—Hill, Van Santen, Steadman & Simpson

[57] ABSTRACT

The exemplary embodiments produce successive x-ray beams with different wavelengths and may comprise a rotating anode whose anode body has x-ray generating parts of different materials. Heretofore, the x-rays arising at the parts have been conducted through filters outside the tube which, synchronously moved, are allocated to the parts of the rotating anode. Since, however, the allocation of the filters to the parts of the anode is difficult in such a subsequent synchronization, according to the disclosure a fixed allocation ensues in that the filters are incorporated into the tube and are integrated in the rotation of the anode. To that end, they are designed as walls lying at right angles in the discharge path of the x-rays and are rigidly connected to the shaft of the anode arrangement. Such x-ray tubes are particularly suitable as a radiation source for employment in medical x-ray diagnostics.

4 Claims, 4 Drawing Figures

ROTATING ANODE X-RAY TUBE

BACKGROUND OF THE INVENTION

The invention relates to a rotating anode x-ray tube according to the preamble of patent claim 1. A tube of this type is diclosed, for example, in the U.S. Pat. No. 3,229,089.

For producing high-contrast x-ray images of specimens which absorb differently for x-rays of different wavelengths, images, as is known, have been produced with rays of different wavelengths and these have then been subtracted from one another. To that end, however, the images to be subtracted from one another should be produced as close together in time as possible, i.e., simultaneously. Therefore, x-rays with different wavelengths (hardness of radiation) which were produced in one and the same radiator were employed for producing practically simultaneous x-ray images with different contrast. To that end, as mentioned, for example, in the aforementioned reference, an x-ray tube was employed which has an anode which consists of sectors with different materials. Moreover, in order to achieve x-rays which are as approximately monochromatic as possible, a filter is also provided which consists of a plurality of sectors with different material corresponding to the plurality of sectors of the anode, so that the x-rays passing through the filter receive an optimum filtration. Since the materials of the sectors of the filters are matched to those of the anode, the plates, i.e., filter and anode, must be moved synchronously relative to one another so that the allocation is retained. However, it is difficult to also maintain this allocation given the speeds of rotation standard in the operation of x-ray tubes.

SUMMARY OF THE INVENTION

The object of the invention, given a rotating anode x-ray tube according to the preamble of patent claim 1, is to achieve a structurally simple and nonetheless reliable allocation of filters to the parts of the anode consisting of different materials. This object is achieved by means of the measures specified in the characterizing part of said claim 1. Advantageous further embodiments and developments of the invention can be derived from the subclaims.

Given rotating anode x-ray tubes for generating x-rays with different wavelenghts, it is favorable according to the invention to occupy the path of the focal spot track with parts consisting of different materials or, respectively, to construct the anode of different materials on which x-rays of different wavelenghts arise and to integrate filters in the rotation of the anode in that they are rigidly connected to the shaft of the anode as walls lying at right angles relative to the beam direction of the x-rays. Such filters can be put in place as, for instance, collar sectors at the edge of the anode plate which anode plate can consist of sectors of different materials or such different materials can be placed at successive regions along the focal spot track. Given a corresponding selection of the material of the filter parts which are allocated to the respective parts of the anode, a connection to the shaft and, thus, a predesigned structural synchronization of filter and anode is already achieved. Thus, a special synchronization of moving parts, as in the known solution, is avoided in a simple manner.

Another allocation can consist in that the anode is produced of parts, for instance, sectors which are bent over at their ends, so that the bent-over sections represent the filter. Thereby, the advantage is achieved that, by employing the same material for anode and filter, a particularly good filtration is achieved, because only the beams characteristic for the appertaining material are then allowed to pass.

In a further structure solution, the parts of different material can also be achieved as inserts in a correspondingly shaped perforated disk, i.e., a part of the anode on which the focal spot path lies, is provided with holes as is the part of a collar assigned thereto or, respectively, of a bent-over part at the peripheral edge of the anode. Correspondingly selected parts of an anode material and of a filter material respectively allocated to one another can then be inserted into the respective openings.

The materials standard per se in x-ray technology come into consideration as materials for the anode and for the filter as well (cf., for example, the aforementioned U.S. Pat. No. 3,229,089, col. 2, lines 25/26 and 45, where molybdenum, copper and cobalt are specified as anode material and zirconium, nickel and iron are specified as filter material).

However, it is also possible to manufacture the anode of a uniform material and to select the filters in a corresponding manner. Given employment of tungsten for the anode, the selection of the filter from different materials can then ensue. This structural solution is possible because different filter material attenuates different spectral components of the radiation generated at tungsten to differing degrees.

In the following, further details and advantages of the invention are explained on the basis of the exemplary embodiments illustrated in the Figures on the accompanying drawings sheet; and other objects, features and advantages will be appparent from this detailed disclosure and from the appended claims.

DETAILED DESCRIPTION

Figure 1:
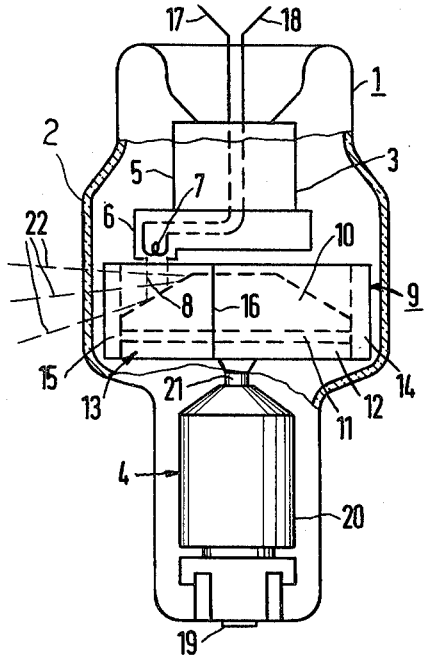
FIG. 1, in a schematic illustration, shows an inventively designed x-ray tube, partially broken away and in section.

In FIG. 1, 1 indicates an x-ray tube having an envelope 2 in which a cathode assembly 3 is mounted at one end and a rotary anode assembly 4 is mounted at the other end. The cathode assembly is comprised of a holding sleeve 5 which exhibits a projection 6 in which the actual cathode 7 is situated. Electrons depart therefrom in a beam 8, striking an anode 9. Said anode 9 is comprised of an anode body 10 of tungsten which is attached to a support 11 of molybdenum to whose lower side a plate 12 of graphite is soldered. A collar 13 which has two semi-circular bent parts 14 and 15 lies around the outer edge of the anode 10 and the plates 11 and 12. The boundary line between parts 14 and 15 lying at the front side is visible in the drawing and is referenced with 16. Provided for the operation of the x-ray tube are, on the one hand, terminals 17 and 18 for heating the thermionic cathode 7. The negative tube voltage lies at one of the terminals 17 or 18 while the positive tube voltage is applied to the anode 9 via a part 19.

During operation of the tube 1, the tube voltage, as previously mentioned, is applied between 19 and 17 or 18. The rotor and, via the shaft 21, the anode 9 is placed in rotation at the same time by means of a stator not illustrated in the drawing. The electrons of the beam 8 striking the anode generate x-rays 22 which, on the one hand, emerge through the filter wall 15 and, on the other hand, emerge through the wall of the tube envelope 2. While the anode is rotating, the parts 14 and 15 of the filter succesively arrive at the beam exit location, so that x-rays of different wavelengths become available. Given employment of tungsten as the material of the anode 10 and molybdenum as the material of the part 14 and iron as the material of the part 15, the x-rays have transmitted wavelengths suitable for the production of x-ray exposures.

Figure 2:
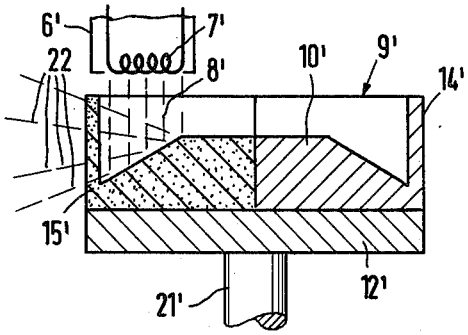
FIG. 2 shows a cross-section through an alternately designed anode.
Figure 3:
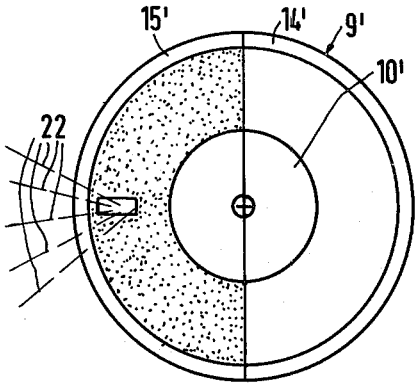
FIG. 3 shows a plan view of the anode according to FIG. 2.

As an alternative to the design of the anode 9 according to FIG. 1, the anode 9' in FIG. 2 is manufactured of two parts 14' and 15' each of which, in a structurally uniform design, includes both a semi-annular focal spot part of the anode as well as an integral filter part, corresponding to collar 14 or 15 of FIG. 1. The two parts 14' and 15' are applied to a support disk 12' at which the shaft 21' also engages. The operation of the anode ensues analogously to the design according to FIG. 1, in that the thermionic cathode 7' of the cathode 6' is heated and, thus, electrons 8' strike the focal spot path of the anode, so that x-rays 22 emerge through the lateral wall of part 14' or 15' and are filtered in a manner corresponding to that in FIG. 1.

Figure 4:
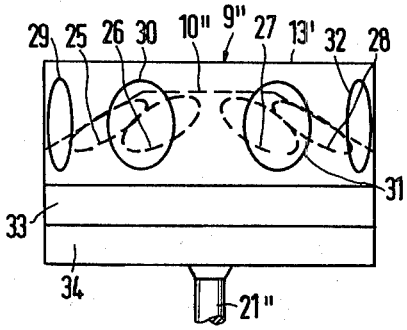
FIG. 4 is a side view of an anode with inserted anode materials and filter windows.

An exemplary embodiment is illustrated in FIG. 4 in which a plurality of parts of different material are inserted in an anode 9'' in the anode body 10''. Parts 25 through 28 thereof are visible in the drawing. Allocated to these parts are windows 29 through 32 which are openings in the lateral collar 13' and in which filters are inserted as the respective different window materials. Given this design, the collar 13' is attached to a support 33 which is in turn attached to a plate 34 of graphite. In order to obtain the rotatability, the arrangement is connected to a shaft 21'' which corresponds with the shaft which is referenced with 21 in FIG. 1.

It will be apparent that many modifications and variations may be made without departing from the scope of the teachings and concepts of the present invention.

I claim as my invention:

1. A rotating anode x-ray tube comprising a shaft, a rotating anode on the shaft designed for generating x-rays with different wavelenghts, characterized in that filters are rotationally integrated with the anode in that they are rigidly connected to the shaft of the anode and form walls lying at right angles relative to the beam output direction.

2. An x-ray tube according to claim 1, the anode comprising an anode disk, characterized in that the filters are attached as a collar to the edge of the anode disk and the andoe disk is designed in the standard manner as a truncated cone.

3. An x-ray tube according to claim 1, characterized in that the sections of the anode and of the respectively allocated filter contain the same material.

4. A tube according to claim 2, characterized in that the disk comprises sectors of different materials each sector having an edge with a bent-over shape, so that the disk with the collar at the edge thereof derives when the sectors are connected to one another.

* * * * *